United States Patent [19]

Chen et al.

[11] 4,440,659

[45] Apr. 3, 1984

[54] LUBRICATING OIL ASHLESS DISPERSANT AND LUBRICATING OILS CONTAINING SAME

[75] Inventors: Jackson C. Chen, Troy; Marguerite S. Baylerian, Huntington Woods; Bryan T. Davis, West Bloomfield; Ellis B. Rifkin, Southfield, all of Mich.

[73] Assignee: Ethyl Corporation, Richmond, Va.

[21] Appl. No.: 350,206

[22] Filed: Feb. 19, 1982

[51] Int. Cl.[3] ..... C10M 1/32

[52] U.S. Cl. ..... 252/51.5 A

[58] Field of Search ..... 252/51.5 A

[56] References Cited

U.S. PATENT DOCUMENTS

| | | | |
|---|---|---|---|
| 2,615,845 | 10/1952 | Lippincott et al. | 252/51.5 A X |
| 2,698,316 | 12/1954 | Giammaria | 252/51.5 A X |
| 3,046,260 | 7/1962 | Stewart et al. | 252/51.5 A X |
| 3,048,544 | 8/1962 | Stewart et al. | 252/51.5 A |
| 3,067,163 | 12/1962 | Bauer | 252/51.5 A X |
| 3,272,746 | 9/1966 | Le Suer et al. | 252/47.5 |
| 4,089,794 | 5/1978 | Engel et al. | 252/51.5 A |
| 4,160,739 | 7/1979 | Stambaugh et al. | 252/51.5 A X |
| 4,195,008 | 3/1980 | Gruber | 260/29.7 |
| 4,219,432 | 8/1980 | Girgenti et al. | 252/51.5 A |

*Primary Examiner*—Andrew Metz

*Attorney, Agent, or Firm*—Donald L. Johnson; John F. Sieberth; Joseph D. Odenweller

[57] ABSTRACT

A lubricating oil dispersant is made by grafting an alkyl methacrylate or acrylate and maleic anhydride onto a Bright Stock mineral oil backbone using a free radical generating catalyst and then reacting the product with an amine to form amide or imide groups.

20 Claims, No Drawings

LUBRICATING OIL ASHLESS DISPERSANT AND LUBRICATING OILS CONTAINING SAME

BACKGROUND

It has been reported that ethylenically unsaturated monomers can be grafted onto mineral oil. U.S. Pat. No. 4,195,008 discloses such a process in the preparation of a carpet backing. It is also reported in U.S. Pat. No. 3,272,746 that in the preparation of ashless dispersants by the reaction of a hydrocarbon-substituted succinic anhydride with an amine that highly refined saturated white oils can be used as the hydrocarbon substituent. U.S. Pat. No. 4,089,794 describes the reaction of maleic anhydride with olefin polymer in a mineral oil solvent. It is noted that some of the maleic anhydride can react with the mineral oil.

Most commercial ashless dispersants are made by reacting maleic anhydride with a high molecular weight olefin polymer such as polyisobutylene followed by reaction with an amine to form amide or imide groups. It has also been reported that useful dispersants can be made by co-grafting alkyl acrylates or methacrylates and maleic anhydride onto an ethylene/propylene copolymer (U.S. Pat. No. 4,160,739).

SUMMARY OF THE INVENTION

It has now been discovered that useful ashless dispersants can be made by co-grafting maleic anhydride and an alkyl acrylate or methacrylate onto a Bright Stock mineral oil backbone followed by reaction with an amine to form amides and/or imides.

DESCRIPTION OF PREFERRED EMBODIMENTS

A preferred embodiment of the invention is an ashless dispersant suitable for use in lubricating oil, said dispersant being made by a process comprising (1) reacting 100 parts by weight of a Bright Stock mineral oil with about 1–15 parts by weight of a $C_{1-20}$ alkyl acrylate or methacrylate and about 1–25 parts by weight of maleic anhydride in the presence of a free radical-generating catalyst at a temperature high enough to form free radicals up to about 250° C. to form a succinic grafted intermediate, and (2) reacting said intermediate with an amine containing 1–30 carbon atoms and 1–6 amine groups, at least one of said amine groups being a primary or secondary amine group, the amount of said amine being sufficient to provide at least one primary or secondary amine group for each grafted succinic group at a temperature high enough to cause the formation of succinamide or succinimide groups up to about 250° C.

Bright Stock is a heavy mineral oil. It has an average molecular weight of about 600–1100. It is derived from Cylinder Stock. Cylinder Stocks have a normal boiling range above Neutral oils in the vicinity of 800°–1200° F. Actual distillation is conducted under vacuum and/or steam to avoid thermal decomposition which can occur above 680° F. The Cylinder Stock is dewaxed by well known refinery methods such as chilling a naphtha or propane solution of Cylinder Stock to precipitate wax crystals which can be removed by filtration through Fuller's Earth and centrifugation. The naphtha is then distilled out and the dewaxed oil can be re-distilled using vacuum and/or steam to avoid thermal decomposition and discoloration.

Suitable acrylates and methacrylates include those in which the alkyl groups contain 1 to about 20 carbon atoms such as methyl methacrylate, ethyl methacrylate, n-propyl acrylate, n-butyl methacrylate, isobutyl acrylate, 2-ethylhexyl methacrylate, n-octyl acrylate, n-dodecyl methacrylate, 2-ethyl-octyl acrylate, 2-ethyl-decyl methacrylate, n-tetradecyl acrylate, 2-methyl-octadecyl acrylate, 2-ethyl-octyldecyl methacrylate, stearyl methacrylate and n-eicosyl acrylate.

Of the above, the preferred grafting agents are the alkyl methacrylates, especially those in which the alkyl group contains about 1–12 carbon atoms. The most preferred alkyl methacrylate is methyl methacrylate.

The amount of alkyl acrylate or methacrylate used in the reaction can vary over a wide range. A useful range is about 1–25 parts by weight for each 100 parts by weight of Bright Stock. A more preferred range is about 5–15 parts for each 100 parts of Bright Stock.

In place of maleic anhydride other derivatives of maleic anhydride can be used which will give substantially equivalent results. These include maleic acid and lower maleate esters such as the methyl, ethyl, propyl and butyl esters.

The amount of maleic anhydride can vary from 1 to about 25 parts by weight for each 100 parts of Bright Stock. The dispersant effectiveness of the products appear to vary somewhat with the weight ratio of Bright Stock:maleic anhydride:alkyl methacrylate or acrylate. A preferred weight ratio is 100:7–20:5–15. When using methyl methacrylate the optimum ratio is about 100:10–15:5–10.

The graft reaction is catalyzed by free radicals. The amount of free radical-generating catalyst can vary over a wide range. A useful range is about 0.5–20 parts by weight for each 100 parts of Bright Stock. A more preferred range is about 0.5 to 5 parts per 100 parts Bright Stock. The catalyst can all be added to the start of the reaction but is preferably added in increments during the course of the reaction.

Useful free radical-generating catalysts include peroxides and azo compounds such as di-tert-butyl peroxide, tert-butyl perbenzoate, tert-butyl hydroperoxide, dicumyl peroxide, cumene hydroperoxide, dibenzoyl peroxide, dilauroyl peroxide, tert-butyl peroctoate, azobisisobutyronitrile, azodicarbonamide, and the like. The preferred catalyst is di-tert-butyl peroxide.

The graft reaction is conducted by forming a mixture of Bright Stock, maleic anhydride, alkyl acrylate and or methacrylate and free radical-generating catalysts. This mixture is stirred at a temperature high enough to cause the formation of free radicals but not so high as to cause undesirable decomposition of either reactants or products. A useful temperature range in which to experiment is about 30°–250° C. When using di-tert-butyl peroxide as the catalyst, good results are obtained at about 125°–200° C.

The graft reaction is carried out long enough to obtain a substantial amount of grafting of the co-monomers to the Bright Stock. This is usally accomplished in about 0.5–12 hours. A preferred reaction time is about 1–8 hours.

Following the graft reaction, any unreacted volatile material can be removed from the intermediate by heating to a temperature high enough to distill out unreacted material but not high enough to distill the graft intermediate. The unreacted material can include maleic anhydride and alkyl acrylate and methacrylate or lower maleic acid polymers thereof. Preferably the graft intermediate is stripped at reduced pressure. Good results are obtained by stripping at about 10–200 mm. Hg abs and 100°–200° C.

In the next stage the intermediate now having alkyl acrylate or methacrylate grafted units and maleic anhydride grafted units is reacted with an amine. Preferred amines contain about 1–30 carbon atoms, and 1–6 amine groups, at least one of which is a primary or secondary amine group. Representative examples of amines include methylamine, ethylamine, n-propylamine, isobutylamine, 2-ethylhexylamine, laurylamine, stearylamine, eicosylamine, triacontylamine, ethanol amine, isopropanol amine, diethanol amine, N,N-dimethyl-1,3-propane diamine, 1,6-diaminohexane, piperazine, piperidine, N-(2-aminoethyl)piperazine, N-(3-aminopropyl)-morpholine, N-(2-aminoethyl)morpholine, dodecyl oxypropylamine, octadecyloxypropylamine, N-dodecyl-1,3-propane diamine, N-octadecyl-1,3-propane diamine, and the like.

Preferred amines are the alkylene polyamines which have the structure $$H_2N\text{-}(R\text{—}NH)_n H$$

in which R is a divalent hydrocarbon group containing 2–3 carbon atoms and n is an integer from 1–10. Examples of these are ethylenediamine, diethylenetriamine, triethylenetetramine, tetraethylenepentamine, pentaethylenehexamine, hexaethyleneheptamine, heptaethyleneoctamine, propylenediamine, dipropylenetriamine, tripropylenetetramine, and the like, including mixtures thereof.

Of the above the more preferred are the ethylene polyamines. Of these the more preferred are mixtures of ethylene polyamines in which n ranges from 3 to 7 and has an average value of about 4–6.

The amount of amine reactant should be an amount that provides at least one primary or secondary amine group for each succinic group in the graft intermediate. The amount of amine can be increased but there is no advantage in using an amount in excess of two moles of amine for each succinic group. If greater amounts are used, any unreacted amine can be removed by distillation, preferably at reduced pressure, e.g. 25–100 mm. Hg abs at 100–200° C.

The amine is added to the graft intermediate and the reaction mixture stirred preferably under nitrogen at a temperature high enough to cause the amine group to react with the succinic group to form succinamide and/or succinimide groups. This can be accomplished at temperatures of about 100°–250° C. Any water which is formed in the reaction is distilled out during the course of the reaction. The reaction may be conducted at reduced pressure in order to aid in the removal of water. Alternatively, the reaction may be conducted at atmospheric pressure and the pressure reduced towards the end of the reaction to facilitate water removal. As mentioned previously, the reaction mixture is preferably stripped at the end by reducing pressure to remove residual water and any unreacted amine.

The following examples serve to show how the graft intermediates are made.

EXAMPLE 1

In a reaction vessel under nitrogen was placed 250 grams of Bright Stock (Chevron Bright Stock 35), 25 grams maleic anhydride and 15 grams methyl methacrylate. The stirred mixture was heated to 80° C. and 0.5 gram tert-butyl peroxybenzoate was added. This mixture was heated to 145° C. and stirred at that temperature for 8 hours. At 1.5 hour intervals during the reaction, additional 0.5 gram portions of tert-butyl peroxybenzoate were added until a total of 2.5 grams had been added. Pressure was reduced to 45 mm. Hg for 3 hours to distill out volatiles. The residual product showed strong succinic anhydride and ester bands by infrared analysis. Weight gain showed that 64 percent of the maleic anhydride had been incorporated into the product as succinic groups.

EXAMPLE 2

Example 1 was repeated using 250 grams Bright Stock 35, 37.5 grams maleic anhydride, 22.5 grams methyl methacrylate and the same catalyst. Infrared analysis again showed strong succinic anhydride and ester bands. Fifty four percent of the maleic anhydride was incorporated in the product.

EXAMPLE 3

In a reaction vessel was placed 200 grams Bright Stock 35, 30 grams maleic anhydride and 24 grams methyl methacrylate. This was heated under nitrogen to 80° C. and then 2 grams di-tert-butyl peroxide was added. The temperature was raised to 145° C. and held there 2.4 hours. The mixture was then stripped of volatiles at 145° C./45 mm Hg for two hours. Weight gain indicated 80 percent utilization of the maleic anhydride into the graft intermediate.

EXAMPLE 4

In a reaction vessel was placed 200 grams of Bright Stock 35, 30 grams maleic anhydride and 18 grams methyl methacrylate. The mixture was heated to 80° C. and 2 grams di-tert-butyl peroxide was added. The mixture was heated to 145° C. and stirred for 2.5 hours. Another 2.1 grams di-tert-butyl peroxide was added and stirred continuously for 2.5 hours. Volatiles were then stripped at 145° C./45 mm Hg for 2 hours. Infrared analysis showed formation of succinic groups. Weight gain showed 85 percent utilization of the maleic anhydride.

EXAMPLE 5

In a reaction vessel was placed 250 grams of Bright Stock 35, 25 grams maleic anhydride and 15 grams methyl methacrylate. The mixture was heated to 80° C. and 1.25 grams di-tert-butyl peroxide was added. Heating was continued to 145° C. and held there 2.5 hours. Another 1.25 grams di-tert-butyl peroxide was added and the reaction continued for 2.5 hours. The mixture was then stripped at 145° C./45 mm Hg for 2 hours. Infrared analysis indicated formation of succinic groups. Weight gain showed 72 percent utilization of the maleic anhydride.

EXAMPLE 6

Into a reaction vessel was placed 1000 grams Bright Stock 35, 100 grams maleic anhydride and 60 grams of methyl methacrylate. The mixture was heated to 80° C. and 10 grams di-tert-butyl peroxide was added. It was then heated to 145° C. and held for 1.75 hours. Another 10 grams di-tert-butyl peroxide was added and heating continued for 2.25 hours. The reaction product was then stripped of volatiles at 145° C./45 mm Hg for 2 hours leaving a graft intermediate.

The following examples show the conversion of the graft intermediate to amide-imide products by reaction with an amine.

EXAMPLE 7

In a reaction vessel under nitrogen was placed 90 grams of the graft intermediate from Example 1. To this was added 15.27 grams of hydrogenated tallow amine and the mixture heated to 160° C. under nitrogen. Stirring was continued for one hour at which time pressure was reduced to 50 mm Hg and volatiles distilled out at 160° C. pot temperature. A total of 1.98 grams of volatiles was recovered. Infrared analysis of the residual product showed both succinimide and ester bands.

EXAMPLE 8

In a reaction vessel was placed 87.3 grams of the graft intermediate from Example 1 and 8.42 grams of an ethylene polyamine mixture having the average composition of tetraethylenepentamine. The mixture was heated to 160° C., 29.1 grams of a process oil was added and the diluted mixture was then stirred at 160° C./50 mm Hg for 4 hours. Infrared analysis showed a small amount of anhydride present so an additional 0.7 grams of ethylene polyamine was added and the mixture stirred at 160° C./50 mm Hg for an additional hour. Infrared analysis showed strong succinimide and ester bands.

EXAMPLE 9

In a reaction vessel was placed 95.8 grams of the graft intermediate from Example 5 and 6.74 grams of the same ethylene polyamine used in Example 8. The mixture was heated at 160° C. for 45 minutes and then at 160° C./50 mm Hg for 2.25 hours. Infrared analysis showed imide, ester and only a small amount of anhydride.

EXAMPLE 10

In a reaction vessel was placed 85 grams of the intermediate from Example 5 and 18.28 grams of hydrogenated tallow amine. The mixture was heated at 160° C. for 2.25 hours leaving a useful oil soluble ashless dispersant.

EXAMPLE 11

In a reaction vessel was placed 44.43 grams of the intermediate from Example 4 and 3 grams of 1,6-hexane diamine. The mixture was stirred at 160° C. for 45 minutes and then at 160° C./50 mm Hg for 2.25 hours. The product is an effective dispersant.

EXAMPLE 12

In a reaction vessel was placed 101.4 grams of the graft intermediate from Example 6 and 5.07 grams of diethylenetriamine. The mixture was stirred at 160° C. for 4 hours and then at 160° C./50 mm Hg for 2 hours. A 10.02 gram portion of the product was removed and diluted with 200 ml of hexane. The solution was filtered and the filtrate stripped of hexane at steam temperature and 50 mm Hg leaving a bright clear dispersant.

Tests were conducted to demonstrate the sludge dispersing properties of the new dispersants in lubricating oil. A 100 ml. oil sample was prepared containing 7 grams of typical engine sludge, 2 grams of water and varying concentrations of the test additive. The sample was then stirred vigorously in a blender to disperse the sludge and then centrifuged for 2.5 hours at 2000 rpm to accelerate sludge settling. Then a small amount of oil was withdrawn from just beneath the surface of the oil and the percent light transmittance of this small sample was measured photoelectrically. The more effective the additive is in keeping the sludge dispersed in the oil, the lower will be the amount of light transmitted through the small sample. The following table gives the percent light transmittance of two test additives at varying concentration.

| | Additive Concentration, Percent | | |
|---|---|---|---|
| Additive | 0.5 | 0.15 | 0.10 |
| Example 9 | 2.5 | 8.5 | 60 |
| Example 12 | 0.5 | 8.5 | 39 |

In the above tests without any dispersant the light transmittance was 63.8 and 66.0 on replicate samples. Thus, the additives are very effective in retaining engine sludge in suspension.

The additives are added to lubricating oil in an amount which improves the dispersant properties of the oil. A useful concentration is about 0.5–10 weight percent. A more preferred range is about 1.0–7 weight percent.

The additives can be used in mineral oil or in synthetic oils of viscosity suitable for use in the crankcase of an internal combustion engine. Crankcase lubricating oils have a viscosity up to about 80 SUS at 210° F. Sometimes such motor oils are given a classification based on viscosity at both 0° and 210° F., such as SAE 10W 40 or SAE 5W 30.

Mineral oils include those of suitable viscosity refined from crude oil from all sources including Gulfcoast, midcontinent, Pennsylvania, California, Alaska, North Sea, and the like. Various standard refinery operations can be used in processing the mineral oil.

Synthetic oil includes both hydrocarbon synthetic oil and synthetic esters. Useful synthetic hydrocarbon oils include liquid polymers of $\alpha$-olefins having the proper viscosity. Especially useful are the hydrogenated liquid oligomers of $C_{6-12}$ $\alpha$-olefins such as $\alpha$-decene trimer. Likewise, alkylbenzenes of proper viscosity can be used, such as didodecylbenzene.

Useful synthetic esters include the esters of both monocarboxylic acid and polycarboxylic acid as well as monohydroxy alkanols and polyols. Typical examples are didodecyl adipate, trimethylolpropane tripelargonate, pentaerythritol tetracaproate, di-(2-ethylhexyl)adipate, dilauryl sebacate, and the like. Complex esters prepared from mixtures of mono- and dicarboxylic acid and mono- and polyhydroxyl alkanols can also be used.

Blends of mineral oil with synthetic oil are particularly useful. For example, blends of 5–25 weight percent hydrogenated $\alpha$-decene trimer with 75–95 weight percent 150 SUS (100° F.) mineral oil results in an excellent lubricant. Likewise, blends of about 5–25 weight percent di-(2-ethylhexyl)adipate with mineral oil of proper viscosity results in a superior lubricating oil. Also blends of synthetic hydrocarbon oil with synthetic esters can be used. Blends of mineral oil with synthetic oil are especially useful when preparing low viscosity oil (e.g. SAE 5W 20) since they permit these low viscosities without contributing excessive volatility.

The more preferred lubricating oil composition includes zinc dihydrocarbyldithiophosphate (ZDDP) in combination with the present additives. Both zinc dialkyldithiophosphates and zinc dialkaryldithiophosphates as well as mixed alkyl-aryl ZDDP are useful. A typical alkyl-type ZDDP contains a mixture of isobutyl and isoamyl groups. Zinc di-(nonylphenyl)dithiophosphate is a typical aryl-type ZDDP. Good results are achieved using sufficient ZDDP to provide about 0.01–0.5 weight percent zinc. A preferred concentration supplies about 0.05–0.3 weight percent zinc.

Another additive used in the oil compositions are the alkaline earth metal petroleum sulfonates or alkaline earth metal alkaryl sulfonates. Examples of these are calcium petroleum sulfonates, magnesium petroleum sulfonates, barium alkaryl sulfonates, calcium alkaryl sulfonates or magnesium alkaryl sulfonates. Both the neutral and the overbased sulfonates having base numbers up to about 400 can be beneficially used. These are used in an amount to provide about 0.05–1.5 weight percent alkaline earth metal and more preferably about 0.1–1.0 weight percent. In a most preferred embodiment the lubricating oil composition contains a calcium petroleum sulfonate or alkaryl (e.g. alkylbenzene) sulfonate.

Viscosity index improvers can be included such as the polyalkylmethacrylate type or the ethylene-propylene copolymer type. Likewise, styrene-diene VI improvers or styrene-acrylate copolymers can be used. Alkaline earth metal salts of phosphosulfurized polyisobutylene are useful.

The crankcase oils can also contain other ashless dispersants such as the polyolefin-substituted succinamides and succinimides of ethylene polyamines such as tetraethylenepentamine. The polyolefin succinic substituent is preferably a polyisobutene group having a molecular weight of from about 800 to 5,000. Such ashless dispersants are more fully described in U.S. Pat. Nos. 3,171,892 and 3,219,666 incorporated herein by reference.

Another useful class of ashless dispersants are the polyolefin succinic esters of mono- and polyhydroxyl alcohols containing 1 to about 40 carbon atoms. Such dispersants are described in U.S. Pat. Nos. 3,381,022 and 3,522,179.

Likewise, mixed ester amides of polyolefin substituted succinic acid made using alkanols, amines and/or aminoalkanols represent a useful class of ashless dispersants.

The succinic amide, imide and/or ester type ashless dispersants may be boronated by reaction with a boron compound such as boric acid. Likewise, the succinic amide, imide and/or ester may be oxyalkylated by reeaction with an alkylene oxide such as ethylene oxide or propylene oxide.

Other useful ashless dispersants include the Mannich condensation products of polyolefin-substituted phenols, formaldehyde and polyethylene polyamine. Preferably, the polyolefin phenol is a polyisobutylene-substituted phenol in which the polyisobutylene group has a molecular weight of from about 800 to 5,000. The preferred polyethylene polyamine is tetraethylene pentamine. Such Mannich ashless dispersants are more fully described in U.S. Pat. Nos. 3,368,972; 3,413,347; 3,442,808; 3,448,047; 3,539,633; 3,591,598; 3,600,372; 3,634,515; 3,697,574; 3,703,536; 3,704,308; 3,725,480; 3,726,882; 3,736,357; 3,751,365; 3,756,953; 3,793,202; 3,798,165; 3,798,247 and 3,803,039.

The above Mannich dispersants can be reacted with boric acid to form boronated dispersants having improved corrosion properties.

We claim:

1. An ashless dispersant suitable for use in lubricating oil, said dispersant being made by a process comprising (1) heating a mixture of reactants consisting essentially of 100 parts by weight of a Bright Stock mineral oil, about 1–25 parts by weight of a $C_{1-20}$ alkyl acrylate or methacrylate and about 1–25 parts by weight of maleic anhydride in the presence of a free radical-generating catalyst at a temperature high enough to form free radicals up to about 250° C. to form a succinic grafted intermediate, and (2) reacting said intermediate with an amine containing 1–30 carbon atoms and 1–6 amine groups, at least one of said amine groups being a primary or secondary amine group, the amount of said amine being sufficient to provide at least one primary or secondary amine group for each grafted succinic group at a temperature high enough to cause the formation of succinamide or succinimide groups up to about 250° C.

2. An ashless dispersant of claim 1 wherein said acrylate or methacrylate is a $C_1$–$C_{20}$ alkyl methacrylate.

3. An ashless dispersant of claim 2 wherein said free radical generating catalyst is a peroxide.

4. An ashless dispersant of claim 2 wherein said alkyl methacrylate is methyl methacrylate.

5. An ashless dispersant of claim 1 wherein said amine is an alkylenepolyamine having the formula $$H_2N\text{-}(R\text{—}NH)_nH$$

wherein R is a divalent hydrocarbon group containing 2–3 carbon atoms and n is an integer from 1–10.

6. An ashless dispersant of claim 5 wherein said acrylate is a $C_{1-20}$ alkyl methacrylate.

7. An ashless dispersant of claim 6 wherein said $C_{1-20}$ alkyl methacrylate is methyl methacrylate.

8. An ashless dispersant of claim 7 wherein said free radical-generating catalyst is a peroxide.

9. An ashless dispersant of claim 8 wherein said peroxide is di-tert-butyl peroxide.

10. A composition comprising a major amount of an oil of lubricating viscosity and a dispersing amount of an ashless dispersant of claim 1.

11. A composition of claim 10 wherein said acrylate or methacrylate is a $C_{1-20}$ alkyl methacrylate.

12. A composition of claim 11 wherein said amine is an alkylene polyamine having the structure $$H_2N\text{-}(R\text{—}NH)_nH$$

wherein R is a divalent hydrocarbon group containing 2–3 carbon atoms and n is an integer from 1–10.

13. A composition of claim 12 wherein said alkyl methacrylate is methyl methacrylate.

14. A composition of claim 13 wherein said free radical-generating catalyst is a peroxide.

15. A composition of claim 14 wherein said peroxide is di-tert-butyl peroxide.

16. An ashless dispersant of claim 1 wherein in said process there are about 1–15 parts by weight of a $C_{1\ 10}$ alkyl acrylate or methacrylate in said mixture of reactants.

17. An ashless dispersant of claim 1 wherein in said process the weight ratio of Bright Stock:maleic anhydride:alkyl methacrylate or acrylate is 100:7–20:5–15.

18. An ashless dispersant of claim 2 wherein in said process said alkyl methacrylate is methyl methacrylate and the weight ratio of Bright Stock:maleic anhydride:-methyl methacrylate is about 100:10–15:5–10.

19. An ashless dispersant of claim 5 wherein in said process said alkylenepolyamine is a mixture of ethylene polyamines in which n ranges from 3 to 7 and has an average value of about 4–6.

20. A composition of claim 10 wherein said amine in said process is a mixture of ethylene polyamines having the structure $$H_2N\text{-}(R\text{—}NH)_n\text{-}H$$

wherein R is a divalent hydrocarbon group containing 2 carbon atoms and n is an integer that ranges from 3 to 7 and has an average value of about 4–6.

* * * * *